United States Patent [19]

Haraszti

[11] 4,323,846

[45] Apr. 6, 1982

[54] RADIATION HARDENED MOS VOLTAGE GENERATOR CIRCUIT

[75] Inventor: Tegze P. Haraszti, Garden Grove, Calif.

[73] Assignee: Rockwell International Corporation, El Segundo, Calif.

[21] Appl. No.: 50,724

[22] Filed: Jun. 21, 1979

[51] Int. Cl.[3] ..... G05F 3/04

[52] U.S. Cl. ..... 323/311; 307/297; 307/304

[58] Field of Search ..... 323/19, 22 R, 311; 307/296 R; 330/277

[56] References Cited

U.S. PATENT DOCUMENTS

| | | | |
|---|---|---|---|
| 3,436,621 | 4/1969 | Crawford | 323/22 R |
| 3,675,143 | 7/1972 | Greene | 330/277 |
| 3,823,332 | 7/1974 | Feryszka et al. | 330/277 |
| 3,913,026 | 10/1975 | Koehler | 330/277 |
| 3,936,676 | 2/1976 | Fujita | 323/22 R |
| 4,205,263 | 5/1980 | Kawagai et al. | 323/22 R |

FOREIGN PATENT DOCUMENTS

| | | | |
|---|---|---|---|
| 2643619 | 3/1978 | Fed. Rep. of Germany | 330/277 |
| 547747 | 5/1977 | U.S.S.R. | 323/22 R |

OTHER PUBLICATIONS

Thin Film Solids, No. 1, pp. 21–25, (Nov. 1972), S3005 0023.

IBM Technical Disclosure Bulletin, vol. 11, No. 4, p. 396, Sep. 1968.

*Primary Examiner*—William H. Beha, Jr.

*Attorney, Agent, or Firm*—H. Fredrick Hamann; Daniel R. McGlynn

[57] ABSTRACT

A voltage generator circuit for producing an output voltage which tracks the threshold voltage variation of the MOS devices on the semiconductor body, the magnitude of the output voltage being equal to or slightly greater than the absolute magnitude of the threshold voltages. The circuit includes two MOSFETs having their conduction paths connected in electrical series, each MOSFET having an applied gate-to-source voltage of $2V_T$. The voltage output terminal is connected to the node between the series connected conduction path terminals of the first and second MOSFETs. Three series connected MOSFETs which form a source follower circuit are also provided for providing the required gate-to-source voltage on the first two MOSFETs.

37 Claims, 3 Drawing Figures

RADIATION HARDENED MOS VOLTAGE GENERATOR CIRCUIT

BACKGROUND OF THE INVENTION

The invention relates to voltage generator circuits for use with digital logic or memory circuits, and in particular to voltage generator circuits which are radiation hardened by circuit design.

There are many applications in which LSI circuits are used in environments which are subject to various type of radiation. The radiation affects various device parameters so as to limit the operational range of the circuit. For example, LSI random access memory circuits are only operable up to a radiation dose equal to $5\times10^3$ rads [Si] total dose, or $3\times10^9$ rads/sec [Si] transient dose rate.

Various process techniques are known for achieving integrated circuit radiation hardening, and some small capacity RAMs have been specifically designed and fabricated to withstand high radiation levels. The drawback of such known radiation hardened circuits is their relatively small storage capacity (for example 64 bits) per chip, their access time and the degree of radiation hardness.

There are various known circuit techniques for providing an MOS voltage generator. These techniques include a resistance divider circuit, a source follower circuit, and an MOS divider circuit. There are disadvantages associated with each of these prior art circuits for providing an MOS voltage generator which makes such approaches unsuitable for use in a radiation environment. The resistance divider circuit, for example, has a large layout size, only fair accuracy, and relatively high power dissipation. Moreover the output voltage of the resistance divider depends on variations in resistivity, length, and width.

The source follower circuit generally permits the output voltage to equal the threshold voltage, however it operates very slowly, provides very small current when its output voltage approaches the threshold voltage, and moreover the threshold voltage is not necessarily equal to the maximum threshold voltage of the driven devices after irradiation takes place.

The MOS divider circuit has a number of problems which also makes it unsuitable for the intended application in a radiation environment. The output voltage depends upon a number of independent device parameters such as the threshold voltage $V_T$, the drain-to-source voltage $V_{DS}$, the gate-to-source voltage $V_{GS}$ the width/length ration W/L, the parameter $K'=\mu(\epsilon ox/T ox)$ (where $\mu$ is the charge carrier mobility, $\epsilon ox$ the dielectric constant of the gate insulating layer and $T ox$ the thickness of the gate insulating layer), the leakage current, the body effect factor $BE=\pm(T ox/\epsilon ox)\sqrt{2q\epsilon_s N}$ (where q is the electronic charge, $\epsilon_s$ the dielectric constant of silicon, and N the concentration of dopant atoms in the silicon substrate), resistivity and supply voltage $V_{DD}$. Moreover the accuracy of such a circuit is very poor, and no fairly large scale change in th supply voltage is allowed. There is relatively high power dissipation and slow operation in the saturation region. Furthermore the output voltage does not vary with the threshold voltage variations resulting from nuclear radiation MOS processing, temperature and voltage biasing effects.

In view of the above noted disadvantages, prior to the present invention there has not been an MOS voltage generator which provides considerable immunity to ionizing radiation degradation by tracking the maximum threshold voltage shifts occurring on an MOS circuit.

SUMMARY OF THE INVENTION

Briefly, and in general terms, a voltage generator for use in radiation environments is disclosed. The voltage generator is preferably implemented as a CMOS/SOS (CMOS/silicon-on-sapphire) circuit which performs parameter tracking to adjust to a wide range of non-uniform on-chip parameter variations which might occur as a result of exposure to radiation, as well as from MOS device processing temperature and supply effects.

The presently disclosed voltage generator includes a source of relatively positive and a source of relatively negative electrical potential; first and second enhancement mode field effect transistors connected in electrical series between said source of relatively positive and said source of relatively negative potential; each having respective conduction path terminals and a control terminal; means for applying a first predetermined potential to said control electrode of said first transistor; means for applying a second predetermined potential to said control electrode of said second transistor, so that a voltage is generated on the node between the conduction path terminals of said first and said second transistors equal to the threshold voltage of said first and said second transistors; and an output connected to the node between the conduction path terminals of said first and said second transistors.

BRIEF DESCRIPTION OF THE DRAWINGS

In the several Figures of the drawing, like reference numerals represent like components.

DESCRIPTION OF THE PREFERRED EMBODIMENTS

Figure 1:
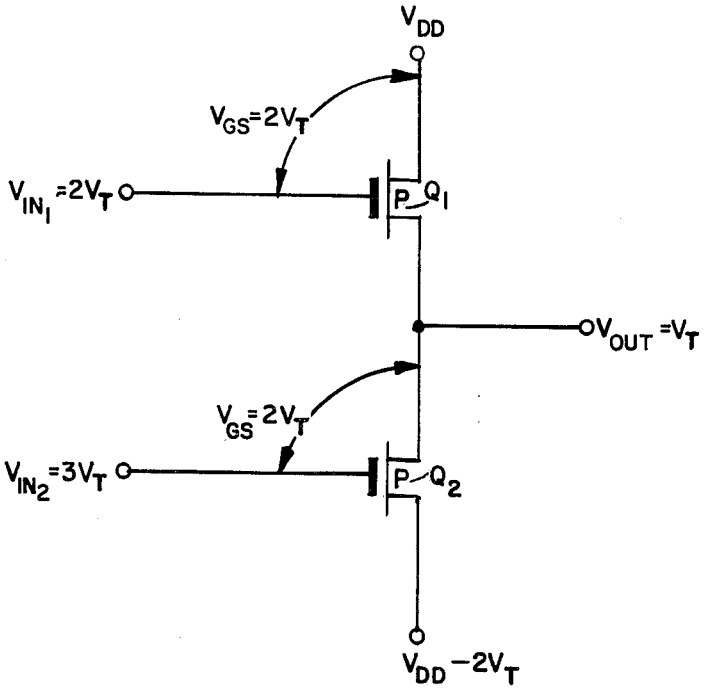
FIG. 1 is a schematic diagram of a highly simplified embodiment of the present invention.

FIG. 1 is a schematic diagram of a highly simplified embodiment of the present invention. FIG. 1 shows a first metal oxide semiconductor field effect transistor (MOSFET) $Q_1$ having its conduction path connected in series between a first source of potential $V_{DD}$ and a second MOSFET $Q_2$. Although MOSFETs are shown in this application, it must be realized that other types of transistor devices having a predetermined threshold voltage which can vary as a function of process temperature, voltage bias, and radiation effects are possible. In the preferred embodiments considered here, both $Q_1$ and $Q_2$ are enhancement mode p-channel MOSFETs with substantially equal $V_T$ threshold voltages, but the invention is not limited to PMOS technology, since NMOS or another technology could be used, and devices other than MOSFETs could be used as well. FIG.

1 also shows a first input labelled $V_{IN1}$ having a potential equal to two times the threshold potential, i.e. $2V_T$. The gate-to-source voltage, $V_{GS}$, of MOSFET $Q_1$ is then equal to $2V_T$. A second input, labelled $V_{IN2}$, is provided with a predetermined potential equal to $3V_T$. The gate-to-source voltage of MOSFET $Q_2$ is then also equal to $2V_T$. The other conduction path terminal of MOSFET $Q_2$ is connected to a second potential source, so that the first and second FETs are connected in electrical series between a source of relatively positive ($V_{DD}$) and a source of relatively negative ($V_{SS}$) potential. In the configuration shown in FIG. 1, the potential at the second terminal of MOSFET $Q_2$ would be equal to $V_{DD}-2V_T$ where $V_{DD}$ is the relatively positive potential of the voltage source. The output of the circuit in FIG. 1, labeled $V_{OUT}$, is connected to the node between the conduction path terminals of the first and the second MOSFETs. If MOSFETs $Q_1$ and $Q_2$ are identically sized, and the indicated potentials are applied to their respective gates, the voltage output $V_{OUT}$ would be equal to $V_T$.

Although FIG. 1 depicts a highly simplified implementation of the present invention, it demonstrates the key elements of the present invention, namely means for applying a first predetermined potential to the control electrode of the first transistor, and means for applying a second predetermined potential to the control electrode of the second transistor so that a voltage is generated on the node between the conduction path terminals of the first and second transistors which is equal to the threshold voltage of such transistors. More specifically, such a voltage is specified by requiring that the gate-to-source voltage of MOSFET $Q_1$ be equal to $2V_T$, and the gate-to-source voltage of MOSFET $Q_2$ be equal to $2V_T$.

The first MOSFET $Q_1$ substantially operates in the triode region, i.e. in the region such that $$I_{Q1}=\beta(V_{GS1}-V_T)\,V_{DS}-\tfrac{1}{2}V_{DS}^2$$

where $I_{Q1}$ is the current through the conduction path of MOSFET $Q_1$; $\beta$ a gain factor; $V_{GS}$ the gate-to-source voltage; $V_T$ the threshold voltage of both $Q_1$ and $Q_2$ devices; and $V_{DS}$ the drain-to-source voltage.

The second MOSFET $Q_2$ substantially operates in the neighborhood of the saturation point:

$$I_{Q2}=\frac{\beta}{2}(V_{GS2}-V_T)^2$$

If $V_{GS1}=V_{GS2}=2V_T$, and for a capacitive load, $$I_{Q1}=I_{Q2}$$

so $$V_T V_{DS}-\tfrac{1}{2}V_{DS}^2=\tfrac{1}{2}V_T^2$$

$$V_T^2-2V_T V_{DS}+V_{DS}^2=0$$

and $V_T=V_{DS}$

Figure 2:
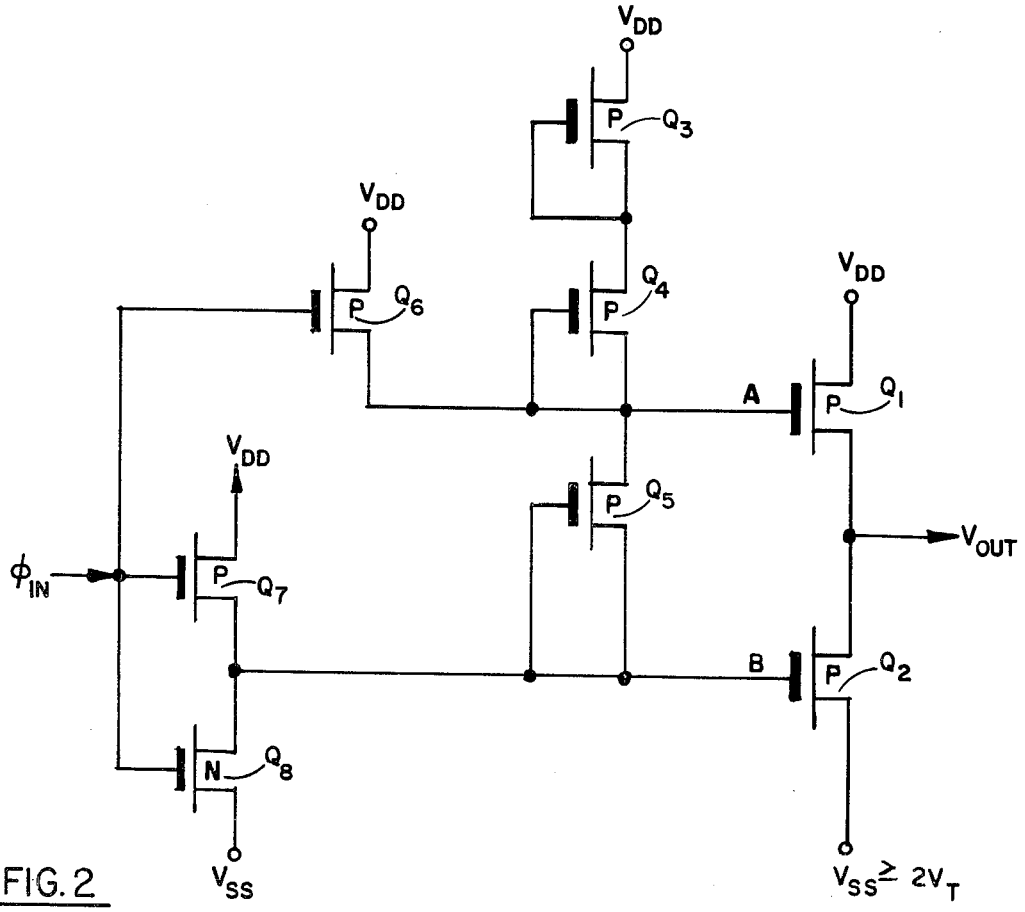
FIG. 2 is a schematic diagram of another embodiment of the present invention incorporating source follower MOSFETs to provide suitable gate voltages to the voltage generator MOSFETs.

FIG. 2 is a schematic diagram of another embodiment of the present invention which incorporates source followers MOSFETs which provide suitable gate voltages to the voltage generator MOSFETs $Q_1$ and $Q_2$. Turning now more specifically to the circuit shown in FIG. 2, the source follower MOSFETs are p-channel MOSFETs $Q_3$, $Q_4$, and $Q_5$, having their conduction path connected in series. The threshold voltages of $Q_1$, $Q_2$, $Q_3$, $Q_4$, and $Q_5$ are also substantially equal to $V_T$. One conduction path terminal of MOSFET $Q_3$ is connected to the source of relatively positive potential, $V_{DD}$. The control terminal of MOSFET $Q_3$ is connected to the other conduction path terminal of MOSFET $Q_3$. One conduction path terminal of MOSFET $Q_4$ is in turn connected to the node formed by the control terminal and the conduction path terminal of MOSFET $Q_3$, while the other conduction path terminal of MOSFET $Q_4$ is connected to the control terminal of MOSFET $Q_4$. One conduction path terminal of MOSFET $Q_5$ is connected to the control terminal of MOSFET $Q_4$ and the conduction path terminal of $Q_4$, while the other conduction path terminal of MOSFET $Q_5$ is connected to its control terminal. The control terminal of MOSFET $Q_4$ is connected to the control terminal of MOSFET $Q_1$. The control terminal of MOSFET $Q_5$ is connected to the control terminal of MOSFET $Q_2$. MOSFETs $Q_3$, $Q_4$ and $Q_5$ form a basic source follower circuit which provides potentials of suitable magnitude to the control electrodes of MOSFETs $Q_1$ and $Q_2$ respectively.

The circuit of FIG. 2 also includes MOSFETs $Q_6$, $Q_7$ and $Q_8$ which perform control functions. MOSFETs $Q_6$ and $Q_7$ are p-channel MOSFETs, while MOSFET $Q_8$ is an n-channel MOSFET. The MOSFETs $Q_7$ and $Q_8$ are therefore complimentary MOS transistors, and are preferably implemented using CMOS/SOS technology. MOSFET $Q_6$ has its first conduction path terminal connected to the first source of relatively positive potential $V_{DD}$, and its second conduction path terminal connected to the control terminal of MOSFET $Q_4$, and thus also to the control terminal of MOSFET $Q_1$. The control terminal of MOSFET $Q_6$ is connected to a control input line which is labeled here $\phi_{IN}$. This $\phi_{IN}$ line provides means for determining a normal mode and a stand-by mode of operation. When clock $\phi_{IN}$ is high, the mode is said to be normal. When $\phi_{IN}$ is low, the mode is said to be stand-by. The significance of the normal and the stand-by mode will be made more specific with reference to FIG. 3 and will be discussed later.

Returning now to the description of FIG. 2, MOSFETs $Q_7$ and $Q_8$ have their conduction path terminals connected in series between a first relatively positive source of voltage $V_{DD}$ and a second relatively negative source of voltage $V_{SS}$. MOSFET $Q_7$ as we have pointed out above is a p-channel MOSFET, while MOSFET $Q_8$ is an n-channel MOSFET. The node between the MOSFETs $Q_7$ and $Q_8$ is connected to the control terminal of MOSFET $Q_5$. The control terminals of MOSFETs $Q_7$ and $Q_8$ are connected together and to the $\phi_1$ input line.

Having discussed the structure of the circuits shown in FIG. 2, we can now turn to its operation.

In active mode when $\phi_{IN}$ is high a potential equal to $V_{DD}$ is applied to the control terminals MOSFETs $Q_6$, $Q_7$, and $Q_8$. Since $Q_6$ and $Q_7$ are p-channel MOSFETs, they are turned off by the high clock signal. $Q_8$ however is an n-channel MOSFET and $Q_8$ is turned on by the high $\phi_{IN}$ signal. Therefore, when the clock $\phi_1$ is high, there is a series connection of MOSFETs $Q_3$, $Q_4$, $Q_5$, and $Q_8$ between $V_{DD}$ and $V_{SS}$. The current of $Q_8$ decreases the voltage on points A and B until a potential of $V_{DD}$ minus $2V_T$ is reached on point A, and a potential of $V_{DD}$ minus $3V_T$ is reached on point B. The output on $V_{OUT}$ would therefore be equal to the $V_T$ for the reason discussed from FIG. 1.

In standby mode when $\phi_{IN}$ is low, MOSFETs $Q_6$ and $Q_7$ are turned on, and MOSFET $Q_8$ is turned off. MOSFETs $Q_6$ and $Q_7$ then shunt $Q_3$, $Q_4$, and $Q_5$ and apply the potential of $V_{DD}$ to MOSFETs $Q_1$ and $Q_2$. Since MOSFETs $Q_1$ and $Q_2$ are p-channel MOSFETs, they are turned off. Although the output voltage of the circuit shown in FIG. 2 varies with processing, temperature and biasing effects on the threshold voltages of the p-channel devices, the operation is still not sufficient for providing a satisfactory voltage generator circuit particularly when the "worst case" threshold voltage shifting occurs by irradiation. The threshold voltage varies as a function of the total ionizing dose. At a total ionizing dose rate beyond $5\times10_3$ rads [Si], there is considerable variation in the potential variation of the threshold voltage depending upon the voltage bias. For example, at $1\times10^6$ rads [Si] for a p-channel MOSFET, a voltage bias $V_{GS}$ equal to minus 10 volts would result in a threshold voltage shift from approximately minus 1 volt to minus 2 volts. However, for the same p-channel MOSFET with a voltage bias $V_{GS}$ equal to $+10$ volts the threshold voltage will shift from minus one volt to minus five volts. This "worst case" shifting occurs at $V_{GS}$ equal to $+V_{DD}$ and $V_{DS}$ equal to 0 on p-channel MOS devices.

Figure 3:
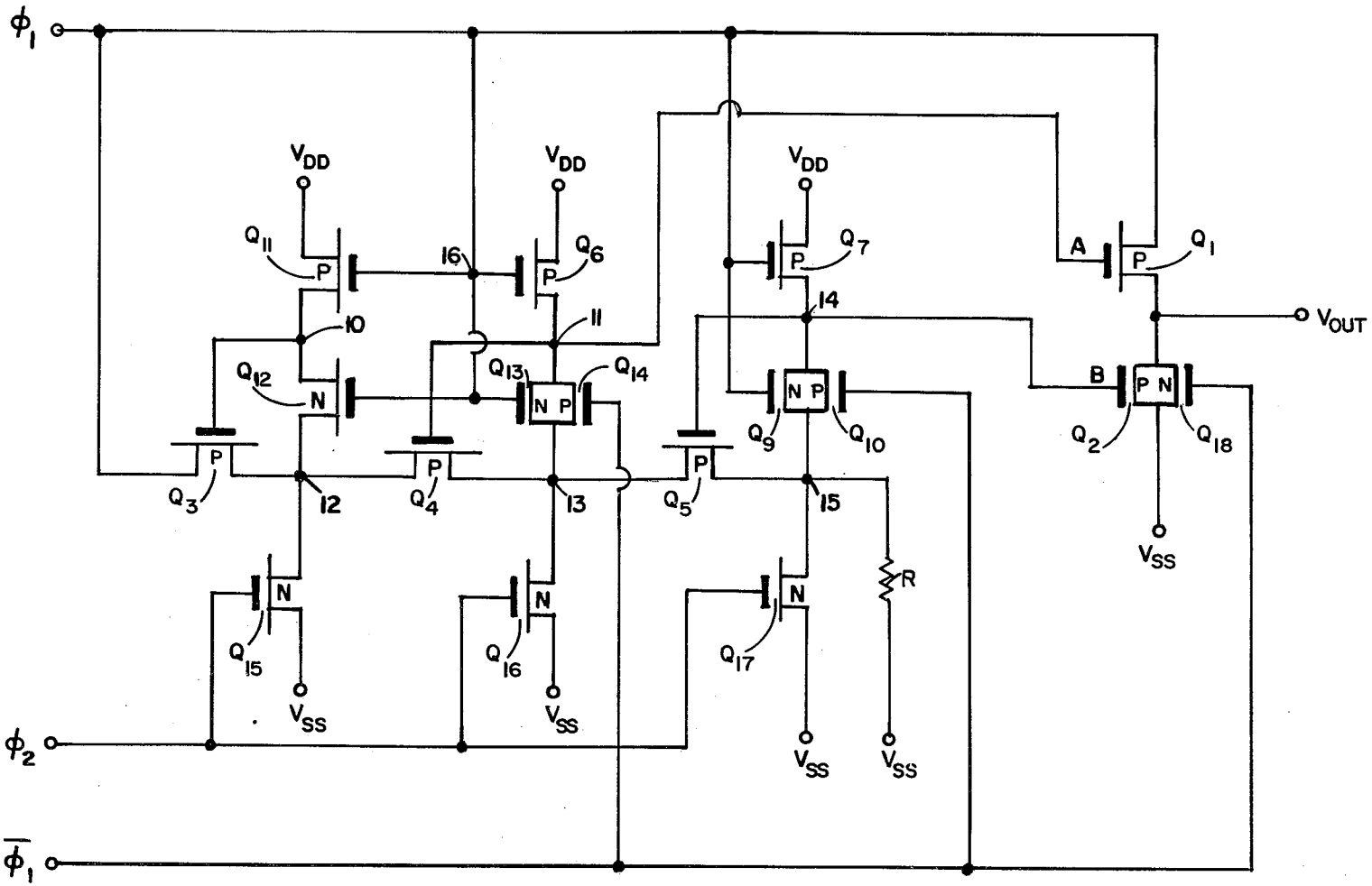
FIG. 3 is a schematic diagram of yet another embodiment of the present invention including not only a source follower MOSFET circuit, but additional MOSFETs for shifting the threshold voltages of the source follower MOSFETs by biasing certain MOSFETs for worst case during the time of irradiation.

FIG. 3 is a schematic diagram of yet another embodiment of the MOS voltage generator circuit according to the present invention which includes not only a source follower circuit but additional devices for shifting the threshold voltages of the source following by biasing certain MOSFETs for "worst case" during the time of irradiation. Turning now to the specific details of the circuit in FIG. 3, we again point out that components with the same reference numerals as those in FIG. 2 and FIG. 1 represent corresponding components in FIG. 3. Thus, MOSFETs $Q_1$ and $Q_2$ are in series connection between a first source of relatively positive potential and a second source of relatively negative potential $V_{SS}$. It is noted that the source of relatively positive potential in FIG. 2 has been substituted in FIG. 3 by the clock input $\phi_1$. On FIG. 3 clock $\overline{\phi_1}$ is the complementary (inverted) signal of clock $\phi_1$. Clock $\phi_2$ is a delayed repetition of clock $\overline{\phi_1}$. The timing difference between $\phi_2$ and $\overline{\phi_1}$ is necessary to assure proper potentials on nodes 15, 13 and 12 for true source follower operation of devices $Q_3$, $Q_4$ and $Q_5$ at switching to normal mode. When the clock input $\phi_1$ is high and $\phi_2$ is low, the circuit is said to be operating in the normal mode. When $\phi_1$ is low and $\phi_2$ is high, the circuit is said to be in stand-by mode. MOSFETs $Q_3$, $Q_4$ and $Q_5$ form the source follower circuit in FIG. 3 as represented by corresponding MOSFETs $Q_3$, $Q_4$, and $Q_5$ in FIG. 2. It is noted that the conduction path terminal of MOSFET $Q_3$ is connected to the clock input $\phi_1$ in FIG. 3. Thus the conduction path terminal of MOSFET $Q_3$ is selectively connectable to the source of relatively positive potential $V_{DD}$ when the clock signal $\phi_1$ is high. The other conduction path terminal of MOSFET $Q_3$ is connected to node 12, and in turn to a first conduction path terminal of MOSFET $Q_4$ like the circuit in FIG. 2. The other conduction path terminal of MOSFET $Q_4$ is in turn connected to node 13, and in turn to a first conduction path terminal of MOSFET $Q_5$. The other conduction path terminal of MOSFET $Q_5$ is connected to a node 15. There is further provided a MOSFET $Q_{11}$ having a first conduction path terminal connected to a source of relative positive potential $V_{DD}$, and a second conduction path terminal connected to a first conduction path terminal of another MOSFET $Q_{12}$ at a common electrical junction 10. MOSFET $Q_{11}$ is a p-channel MOSFET while MOSFET $Q_{12}$ is an n-channel MOSFET. The second conduction path terminal of MOSFET $Q_{12}$ is connected to the second conduction path terminal of MOSFET $Q_3$. The control terminal of MOSFET $Q_3$ is also connected to the common electrical junction 10.

Another p-channel MOSFET $Q_6$ is provided having a first conduction path electrode connected to the source of relatively positive potential $V_{DD}$, and a second connection conduction path electrode connected to a common electrical junction 11. An n-channel MOSFET $Q_{13}$ is provided having a first conduction path electrode connected to the common electrode electrical junction 11 and a second conduction path electrode connected to the common electrical junction 13. The control electrode of MOSFET $Q_4$ is also connected to common electrical junction 11. A p-channel MOSFET $Q_{14}$ is provided in parallel with MOSFET $Q_{13}$ between common electrical junctions 11 and 13. The control electrode of MOSFET $Q_{13}$ is connected to the control electrode of MOSFET $Q_{12}$ as well as to the common electrical junction 16 which is connected to the control electrodes of $Q_{11}$ and $Q_6$. The common electrical junction $Q_{16}$ is further connected to the $\phi_1$ input.

Another p-channel MOSFET $Q_7$ is provided having a first conduction path electrode connected to $V_{DD}$ and second conduction path electrode connected to the common electrical junction 14. In series with the conduction path of MOSFET $Q_7$ is MOSFET $Q_9$. MOSFET $Q_9$ is an n-channel MOSFET having its first conduction path electrode connected to common electrical junction 14 and a second conduction path electrode connected to common electrical junction 15. MOSFET $Q_{10}$ is a p-channel MOSFET in parallel with MOSFET $Q_9$, and has its first conduction path electrode connected to node 14 and second connected to node 15. The control electrode of MOSFET $Q_5$ is connected to the common electrical junction 14. The control electrode of MOSFET $Q_9$ is connected to the control electrode of $Q_7$ and in turn to the $\phi_1$. The control electrode of MOSFET $Q_{12}$ is connected to the clock input $\overline{\phi_1}$, and the control electrode of MOSFET $Q_{13}$ is likewise connected to the clock input $\overline{\phi_1}$.

MOSFETs $Q_{15}$, $Q_{16}$ and $Q_{17}$ are n-channel MOSFETs which are further provided and connected between the source follower MOSFETs and the second source of electrical potential $V_{SS}$. The first MOSFET $Q_{15}$ has its conduction path connected between the node 12 and $V_{SS}$. MOSFET $Q_{16}$ has its conduction path connected between the node 13 and $V_{SS}$. MOSFET $Q_{17}$ has its conduction path connected between the node 15 and $V_{SS}$. The control electrodes of MOSFETs $Q_{15}$, $Q_{16}$, and $Q_{17}$ are connected to a second clock input $\phi_2$. The clock input $\phi_2$ activates the stand-by mode of the circuit. There is further provided a resistor R connected between the node 15 and $V_{SS}$.

There is further provided an n-channel MOSFET $Q_{18}$ having its conduction path connected in parallel with MOSFET $Q_2$. The control electrode of MOSFET $Q_{18}$ is connected to $\overline{\phi_1}$. The operation of the circuit shown in FIG. 3 can now be briefly described.

In normal mode when clock $\phi_1$ is high and clock $\phi_2$ is low, the drains of devices $Q_3$, $Q_4$ and $Q_5$ are individually connected by low resistance with their own gates by means of MOSFETs $Q_{12}$, $Q_{13}$ and $Q_{14}$, and $Q_9$ and $Q_{10}$, respectively. This is true since $\phi_1$ is high $Q_{12}$, $Q_{13}$ and $Q_9$ are on and since $\overline{\phi_1}$ is low, $Q_{14}$ and $Q_{10}$ are also on. The gate of p-channel devices $Q_3$, $Q_4$ and $Q_5$ are separated from $V_{DD}$ since $Q_6$, $Q_7$ and $Q_{11}$ are turned off by the high logical level of clock $\phi_1$. The n-channel device $Q_{18}$ is turned off by the low logical level of clock $\phi_1$. The other n-channel devices $Q_{15}$, $Q_{16}$ and $Q_{17}$ are also turned off separating nodes 12, 13 and 15 from $V_{SS}$. The proper value of resistance R assists to maintain the $3V_T$, $2V_T$ and $V_T$ voltage values on nodes 15, 13 and 12 respectively. In this configuration a voltage of $2V_T$ is generated at node 11 which is applied to the A input of MOSFET $Q_1$, and another potential of $3V_T$ is generated at node 14 which is applied to B input of MOSFET $Q_2$. This way the output voltage related to $V_{DD}$ is $V_T$ in a manner similar to that of FIG. 1 and FIG. 2.

In the stand-by mode clock $\phi_1$ is low and clock $\phi_2$ is high. Therefore MOSFETs $Q_1$–$Q_5$ are all biased so that their drains and sources are at ground potential $V_{SS}$. Moreover their gates are tied to the positive supply $V_{DD}$. This is true since MOSFETs $Q_6$, $Q_7$ and $Q_{11}$ are all on, since they are all p-channel MOSFETs and a low clock signal is applied to their gates from the $\phi_1$ input. MOSFETs $Q_{15}$, $Q_{16}$ and $Q_{17}$ are also all on since they are n-channel MOSFETs and have their gate connected to the $\phi_2$ input, which is high. MOSFETs $Q_{12}$, $Q_{13}$ and $Q_9$ are all off because $\phi_1$ is low, devices $Q_{10}$ and $Q_{14}$ are also off since $\overline{\phi}_1$ is high and therefore there is no conductance between the individual gate and drain of devices $Q_3$, $Q_4$ and $Q_5$. The output node is also on potential $V_{SS}$ since $\phi_1$ is high, which turns n-channel device $Q_{18}$ on. Thus a potential of $V_{DD}$ is applied to gates A and B of MOSFETs $Q_1$ and $Q_2$. The largest radiation induced deviation in threshold voltages for p-channel devices appears when the p-channel MOS device is biased in the manner such that the drain and source are at $V_{SS}$ and the gate is at $V_{DD}$; the radiation "worst case" is then provided for the critical devices $Q_1$ through $Q_5$. Thus an output voltage $V_{OUT}$ equal to $V_{SS}$ is developed at such time.

The present invention therefore achieves parameter tracking both in the normal and the "worst case" bias situations, and permits a wide range of non-uniform on-chip parameter variations which might occur as a result of exposure to radiation, or as a result of MOS processing, or variations in temperature or bias voltage. Moreover, operational range of MOS/LSI circuits is extended to extreme temperature and supply voltages by shifting operating points, precharge voltages, zero- and one- margins along with the shifts in threshold voltage.

Another important consequence of the voltage generator circuit is that the production yield of MOS/LSI circuits can be increased adjusting precharge voltages, operating points and margins in accordance with the actual threshold voltage values provided by the MOS processes.

The circuit density is also greater by permitting the use of minimum size load devices which function to apply gate bias slightly greater than the threshold voltage of the MOS load devices.

It will be apparent that while a preferred embodiment of the radiation hardened voltage generator according to the present invention has been shown and described, various modifications and changes may be made without departing from the true spirit and scope of the invention. The invention may be implemented using n-channel MOSFETs instead of p-channel MOSFETS for MOSFETs $Q_1$ and $Q_2$ respectively. Such a modification may be made if it is desired to have a voltage generator which is to drive n-channel transistor devices in a circuit. Such n-channel circuits self-evidently have different voltage bias conditions for "worst case" change in threshold voltage by radiation. Moreover, a particular source follower circuit is described as being implemented in the present invention, although it is readily apparent to those skilled in the art that alternative circuits may be used to provide appropriate gate bias to MOSFETs $Q_1$ and $Q_2$ for normal and $Q_1$, $Q_2$ as well as for $Q_3$, $Q_4$, $Q_5$ for "radiation hardness" situations.

Having thus set forth a preferred embodiment of the invention, what is claimed is:

1. A voltage generator for tracking the threshold voltage variation of transistor devices comprising:

a pair of terminals for connection across first and second sources of potential;

first and second transistor devices connected in electrical series between said first and said second source of potential; each of said transistor devices having respective conduction path terminals and a control terminal; a first node being formed at the common electrical junction between one of the conduction path terminals of said first transistor, and one of the conduction path terminals of said second transistor;

means for selectively applying a first potential to said control electrode of said first transistor device, comprising a field effect transistor source follower circuit, including:

third and fourth enhancement mode field effect transistors, each having respective conduction path terminals and a control electrode, the conduction path terminals thereof being connected in electrical series between said first source of potential and said control terminal of said first enhancement mode transistor, a second node being formed at the common electrical junction between the conduction path terminals of said third transistor being connected to said second node and the control terminal of said fourth transistor being connected to the control terminal of said first transistor;

first control means connected to said control terminals of said first and fourth enhancement mode field effect transistors for selectively turning said transistors on;

a fifth enhancement mode field effect transistor having respective conduction path terminals and a control electrode, said conduction path terminals thereof being connected in electrical series with the conduction path of said third and fourth enhancement mode field effect transistor, the first conduction path terminal of said fifth transistor connected to the control terminal of said first transistor, the control terminal of said fifth transistor being connected to the control terminal of said second enhancement mode transistor;

means for selectively applying a second predetermined potential to said control electrode of said second transistor device; so that a voltage is generated on said first node substantially equal to the threshold voltage of said first and said second transistor devices; and an output connected to said first node.

2. A voltage generator as defined in claim 1, wherein said first and second transistor devices are first and second enhancement mode MOS field effect transistors, each field effect transistor having source, gate, and drain electrodes.

3. A voltage generator as defined in claim 1, wherein said first and said second source of electrical potential are respectively a source of relatively positive and a source of relatively negative electrical potential.

4. A voltage generator as defined in claim 1, wherein said first source of potential is selectively controllable as a source of relatively positive potential or a source of relatively negative potential of predetermined magnitude, and said second source of potential is a source of relatively negative potential equal to said predetermined magnitude.

5. A voltage generator as defined in claim 1, wherein said means for selectively applying a first predetermined potential to said control electrode of said first transistor device applies a potential whose magnitude tracks said first source of potential such that the voltage between said first source of potential and said control electrode is equal to twice the threshold voltage.

6. A voltage generator as defined in claim 1, wherein the gate-to-source voltage of the first field effect transistor is equal to twice the threshold voltage, and the gate-to-source voltage of the second field effect transistor is equal to twice the threshold voltage.

7. A voltage generator as defined in claim 1 wherein said first and said second transistor devices are p-channel MOS field effect transistors, having source, gate, and drain electrodes, and said "worst case" bias level is a gate-to-source voltage of $V_{DD}$.

8. A voltage generator as defined in claim 1, wherein said transistor devices are implemented in an integrated circuit on a sapphire substrate.

9. A voltage generator as defined in claim 1, wherein said first and said second transistor devices are n-channel MOS field effect transistors, having source, gate, and drain electrodes, and said "worst case" bias level is a gate-to-source voltage of $V_{DD}$.

10. A voltage generator as defined in claim 1, wherein said third, fourth, and fifth transistor devices are n-channel MOS field effect transistors.

11. A voltage generator as defined in claim 1, for in said means for selectively applying a second predetermined potential comprises a complementary MOS field effect transistor circuit.

12. A voltage generator as defined in claim 11, wherein said complementary MOS field effect transistor circuit comprises a first P channel MOS field effect transistor connected in electrical series with a second N channel field effect transistor; a third node being formed at the common electrical junction between one of the conduction path terminals of said first complementary MOS transistor and one of the second conduction path terminals of the second complementary MOS transistor, said third node being connected to said control electrode of said second control transistor device.

13. A voltage generator as defined in claim 12, further comprising activating means connected to the control electrodes of said first and second complementary transistor devices for turning said first complementary MOS transistor devices off and said second MOS transistor device on so that a conduction path is provided between said third, fourth, fifth enhancement mode field effect transistor, said second complementary MOS transistor, and ground.

14. An integrated voltage generator circuit for tracking the threshold voltage variation of transistor devices comprising;

a pair of terminals for connection across first and second sources of electrical potential;

first and second transistor devices connected in electrical series between said first and said second terminals; each of said transistor devices having respective conduction path terminals and a control terminals; a first node being formed at the common electrical junction between one of the conduction path terminals of said first transistor, and one of the conduction path terminals of said second transistor;

means for selectively applying a first potential to said control electrode of said first transistor device;

means for selectively applying a second potential to said control electrode of said second transistor device; so that a voltage is generated on said first node substantially equal to the threshold voltage of said first and said second transistor devices; and an output connected to said first node, characterized in that said means for applying second potential comprises two complementary MOS defined effect transistors.

15. A voltage generator as defined in claim 14, characterized in that said first and second transistor devices are first and second enhancement mode MOS field effect transistors, each field effect transistor having source, gate, and drain electrodes.

16. A voltage generator as defined in claim 15, characterized in that said first and said second source of electrical potential are a source of relatively positive and a source of relatively negative electrical potential respectively.

17. A voltage generator as defined in claim 14, characterized in that said first source of potential is selectively controllable as a source of relatively positive potential or a source of relatively negative potential of predetermined magnitude, and said second source of potential is a source of relatively negative potential equal to said predetermined magnitude.

18. A voltage generator as defined in claim 14, characterized in that said means for selectively applying a first predetermined potential to said control electrode of said first transistor device applies a potential whose magnitude tracks said first source of potential are such that the voltage between said first source of potential and said control electrode is equal to twice the threshold voltage.

19. A voltage generator for tracking the threshold voltage variation of transistor devices comprising:

a variable first and substantially fixed second source of electrical potential;

first and second transistor devices connected in electrical series between said first and said second source of potential; a third transistor device connected in electrical series between said first transistor device and said second source of potential and in parallel with said second transistor device, each of said transistor devices having respective conduction path terminals and a control terminal; a first node being formed at the common electrical junction between one of the conduction path terminals of said first transistor, and one of the conduction path terminals of said second transistor;

means for selectively applying a first predetermined potential to said control electrode of said first transistor device;

means for selectively applying a second predetermined potential to said control electrode of said second transistor device; so that a voltage is generated on said first node substantially equal to the threshold voltage of said first and said second transistor devices; and an output connected to said first node.

20. A voltage generator as defined in claim 19 wherein said variable first source of electrical potential includes a normal mode at a relatively positive potential and a standby mode at a relatively negative potential.

21. A voltage generator as defined in claim 16, characterized in that the gate-to-source voltage of the first field effect transistor is equal to twice the threshold voltage, and the gate-to-source voltage of the second field effect transistor is equal to twice the threshold voltage.

22. A voltage generator as defined in claim 16, characterized in that said means for applying a first predetermined potential comprises a field effect transistor source follower circuit.

23. A voltage generator as defined in claim 22, characterized in that said source follower circuit comprises:

third and fourth enhancement mode field effect transistors each having respective conduction path terminals and a control electrode, the conductor path terminals thereof being connected in electrical series between said first source of potential and said control terminal of said first enhancement mode transistor, a second node being formed at the common electrical junction between the conduction path terminals of said third and fourth transistors, the control terminal of said third transistor being connected to said second node and the control terminal of said fourth transistor being connected to the control terminal of said first transistor.

24. A voltage generator as defined in claim 23, characterized in that said source follower circuit further comprises a fifth enhancement mode field effect transistor having respective conduction path terminals and a control electrode, said conduction path terminals thereof being connected in electrical series with the conduction path of said third and fourth enhancement mode field effect transistor, the control terminal of said fifth transistor being connected to the control terminal of said fifth transistor being connected to the control terminal of said second enhancement mode transistor.

25. A voltage generator as defined in claim 23, characterized in that the generator further comprises control input means connected to said control terminals of said third and fourth enhancement mode field effect transistors for selectively turning said transistors on.

26. A voltage generator as defined in claim 23, characterized in that the generator further comprises first control means connected to said third and fourth enhancement mode field effect transistors for selectively turning such transistors off and applying a predetermined potential to the control electrodes of said first and second transistors.

27. A voltage generator as defined in claim 26, characterized in that the generator further comprises second control means for providing a control signal to said second node.

28. A voltage generator as defined in claim 26, characterized in that said means for applying a first predetermined potential and said means for applying a second predetermined potential to selectively bias said first and said second transistor devices respectively at the "worst case" bias level in terms of the relative change in the threshold voltage before and after irradiation, a voltage equal to said second source of potential being developed at said output.

29. A voltage generator as defined in claim 26 characterized in that said first and said second transistor devices are p-channel MOS field effect transistors, having source, gate, and drain electrodes, and said "worst case" bias level is a gate-to-source voltage of $V_{DD}$, with the drain and source at $V_{SS}$ and the gate at $V_{DD}$.

30. A voltage generator as defined in claim 26 characterized in that said first and said second transistor devices are n-channel MOS field effect transistors.

31. A voltage generator as defined in claim 26 wherein said third, fourth, and fifth transistor devices are n-channel MOS field effect transistors.

32. A voltage generator as defined in claim 19, wherein said first and said third transistor devices are complementary MOS transistors of opposite conductivity.

33. A voltage generator as defined in claim 19, wherein said first and second transistor devices are first and second enhancement mode MOS field effect transistors, each field effect transistor having source, gate, and drain electrodes.

34. A voltage generator as defined in claim 19, wherein said first and said second source of electrically potential are respectively a source of relatively positive and a source of relatively negative electrical potential.

35. A voltage generator as defined in claim 19, wherein said first source of potential is selectively controllable as a source of relatively positive potential or a source of relatively negative potential of predetermined magnitude, and said second source of potential is a source of relatively negative potential equal to said predetermined magnitude.

36. A voltage generator as defined in claim 19, wherein said means for selectively applying a first predetermined potential to said control electrode of said first transistor device applies a potential whose magnitude tracks said first source of potential such that the voltage between said first source of potential and said control electrode is equal to twice the threshold voltage.

37. A voltage generator as defined in claim 33, wherein the gate-to-source voltage of the first field effect transistor is equal to twice the threshold voltage, and the gate-to-source voltage of the second field effect transistor is equal to twice the threshold voltage.

* * * * *

UNITED STATES PATENT AND TRADEMARK OFFICE

CERTIFICATE OF CORRECTION

PATENT NO. : 4,323,846

DATED : April 6, 1982

INVENTOR(S) : Tegze P. Haraszti

It is certified that error appears in the above-identified patent and that said Letters Patent are hereby corrected as shown below:

In column 1, line 51, please delete "$\mu(\varepsilon_{ox}$-" and insert --$\mu \quad \varepsilon_{ox}$/---.

In column 1, line 52, please delete "$T_{ox})$" and insert --$T_{ox}$--.

In column 1, line 52, please delete "$_{\varepsilon}$ox" and insert --$\varepsilon_{ox}$--

In column 1, line 55, please delete "$\pm(T_{ox}/\varepsilon_{ox})$" and insert --$\pm$ $T_{ox}/\varepsilon_{ox}$--.

In column 5, line 14, please delete "$10_3$" and insert --$10^3$--.

In column 7, line 5, please delete "$\phi_1$" and insert --$\overline{\phi}_1$--.

Signed and Sealed this

*Twenty-ninth* Day of *June 1982*

[SEAL]

*Attest:*

GERALD J. MOSSINGHOFF

*Attesting Officer*

*Commissioner of Patents and Trademarks*